US006178908B1

(12) United States Patent
Stolzenberger

(10) Patent No.: US 6,178,908 B1
(45) Date of Patent: Jan. 30, 2001

(54) WIND SCOOP

(76) Inventor: Brian Stolzenberger, 132 Snapper Creek, Layton, FL (US) 33001

( * ) Notice: Under 35 U.S.C. 154(b), the term of this patent shall be extended for 0 days.

(21) Appl. No.: 09/483,591

(22) Filed: Jan. 14, 2000

(51) Int. Cl.[7] ..... B63J 2/00
(52) U.S. Cl. ..... 114/211; 454/82
(58) Field of Search ..... 114/211, 343, 114/364; 454/81, 82; 150/154

(56) References Cited

U.S. PATENT DOCUMENTS

| | | | | |
|---|---|---|---|---|
| 269,533 | * | 12/1882 | Mihan | 454/82 |
| 4,579,232 | * | 4/1986 | Fedak | 211/50 |
| 5,022,339 | | 6/1991 | Baskin | 114/211 |
| 5,588,386 | * | 12/1996 | Schilt | 114/211 |
| 5,778,816 | * | 7/1998 | DiGiulio | 114/211 |

* cited by examiner

*Primary Examiner*—Stephen Avila
(74) *Attorney, Agent, or Firm*—Sanchelima & Assoc. P.C.

(57) ABSTRACT

A wind scoop for hatches and designed to direct and restrict the amount of wind through a hatch opening and if necessary, cut the wind completely. The scoop is collapsible for easy storage and transportation. A rigid sheet is scored to define foldable walls that form an intake opening and direct the wind therethrough. A wall is pivotally housed within the walls and movable between two extreme positions for allowing maximum air through or blocking it. A removable notched bar bites on the distal said of the pivoting wall to keep the latter at a predetermined position. An elastic cord is attached at one end inside the wind scoop and the other end passes through the hatch opening and it is attached to an elongated member with dimensions larger than the opening. The stretched cord keeps the wind scoop in place.

9 Claims, 3 Drawing Sheets

WIND SCOOP

BACKGROUND OF THE INVENTION

1. Field of the Invention

The present invention relates to a wind scoop, and more particularly, to collapsible wind scoops.

2. Description of the Related Art

Many designs for wind scoop have been designed in the past. None of them, however, include the features claimed here. One of the characteristics of the present invention is that it is collapsible. This makes it volumetrically efficient and alleviates storage and transportation logistics. Also, the present invention may be used in adverse weather conditions including during rain and substantial winds.

Applicant believes that the closest reference corresponds to U.S. Pat. No. 5,022,339 issued to Baskin on 1991. However, it differs from the present invention because in Baskin's ventilator, the sloping front panel (22) cannot be set at different positions in order differentiate the amount of air entering the aperture. More important, in bad weather, the patented device would have to be unmounted and the hatch closed.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a wind scoop that is collapsible and volumetrically efficient for transportation and storage.

It is another object of this invention to provide a wind scoop that can be adjusted to different intake configurations depending on the weather. If needed, the present invention can be closed completely.

It is still another object of the present invention to provide a wind scoop that allows for air to enter into a hatch, even while raining.

It is still another object of the present invention to provide a wind scoop that does not require mechanical alteration of the hatch or deck assembly.

It is still another object of this invention to provide a wind scoop with means to close the intake during extreme weather conditions.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
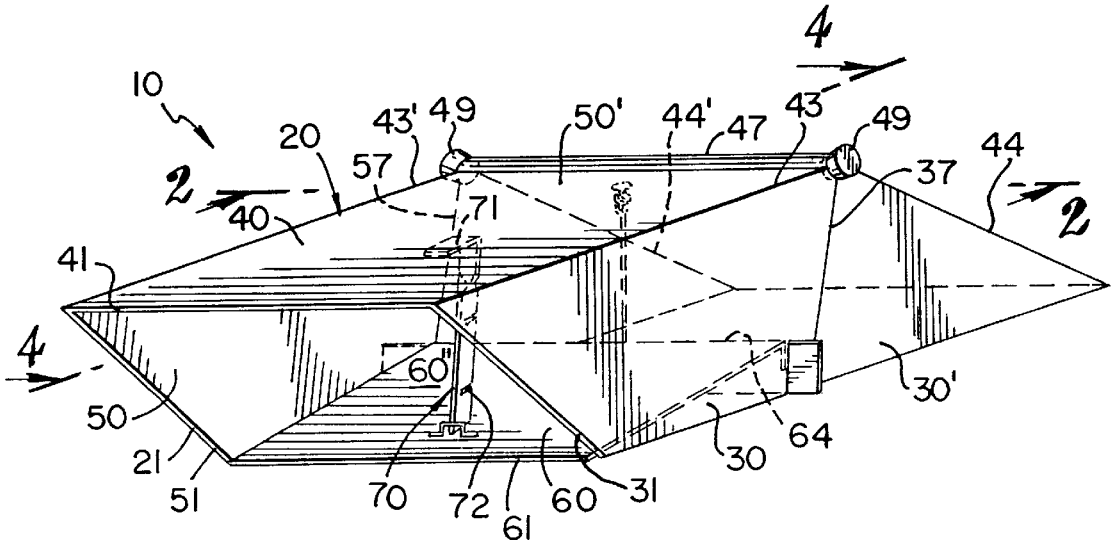
FIG. 1 represents an isometric view of the wind scoop.

Referring now to the drawings, where the present invention is generally referred to with numeral 10, it can be observed that it basically includes sheet member 20 scored at predetermined locations to permit its folding and unfolding. Sheet member 20 is made out of a weather proof material that is bendable after scoring. Examples of suitable materials are polypropilene, polyethylene, and other materials having similar characteristics.

As it can be seen in FIG. 1, front end 21 is defined by front edges 31; 41 and 51 of walls 30; 40 and 50, respectively, which are perpendicularly disposed with respect to each other when scoop 10 is installed. Rear portions 30' and 50' are separated from walls 30 and 50 by integral hinges 37 and 57, respectively. Rear portions 30' and 50' have a triangular shape, in the preferred embodiment. Thus, rear portion 40' of wall 40 extends downwardly towards the horizontal plane of foredeck F from integral hinge 47 and it includes lateral scores 44 and 44'.

Figure 2:
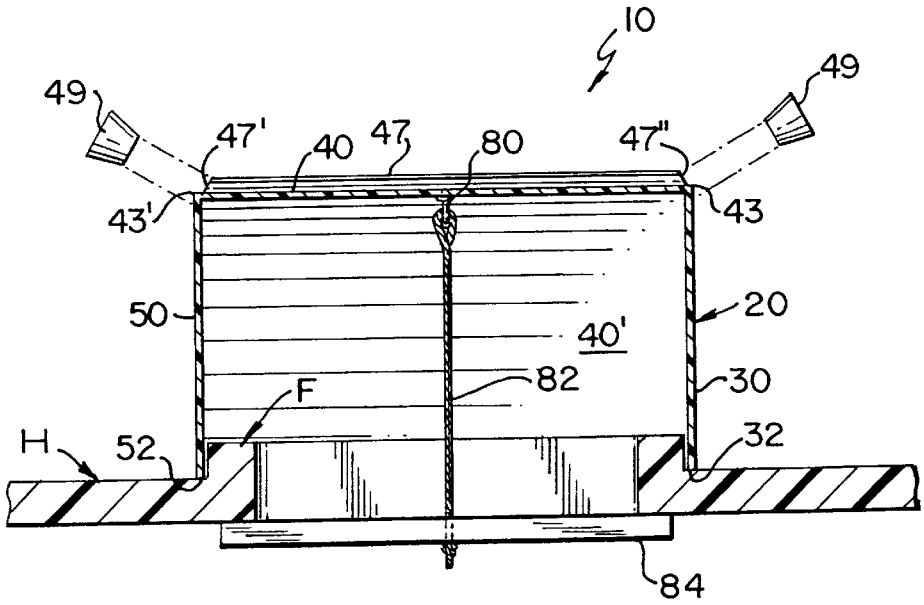
FIG. 2 represents a cross-sectional front elevational view taken along line 2—2 in FIG. 1.

As best shown in FIG. 2, integral hinge openings 47' and 47" are at opposite ends of integral hinge 47. Hinge 47 is formed with two straight and parallel scores. In this manner, sufficient curvature along integral hinge 47 is provided to permit the storage of folded walls 30 and 50 therein. Bottom edges 32 and 52 extend rearwardly and straight, keeping a parallel and spaced apart relationship with respect to each other. End plugs 49 are removably mounted at integral hinge edge openings 47' and 47". Wind scoop 10 is mounted over hatch H or any hatch on foredeck F, without requiring the alteration of its mechanism. Once the present invention 10 is mounted over hatch H, it is secured in place over hatch opening H by elastic cord 82 or the like. Cord 82 in turn is secured, at one end, to loop 80 secured to the inside portion of wall 40. The other end of elastic cord 82 is attached to elongated member 84. Elongated member 84 is longer than the opening of hatch H. The pulling force of stretched elastic cord 82, forces wind scoop 10 downwardly against foredeck F, keeping it in place.

Figure 3:
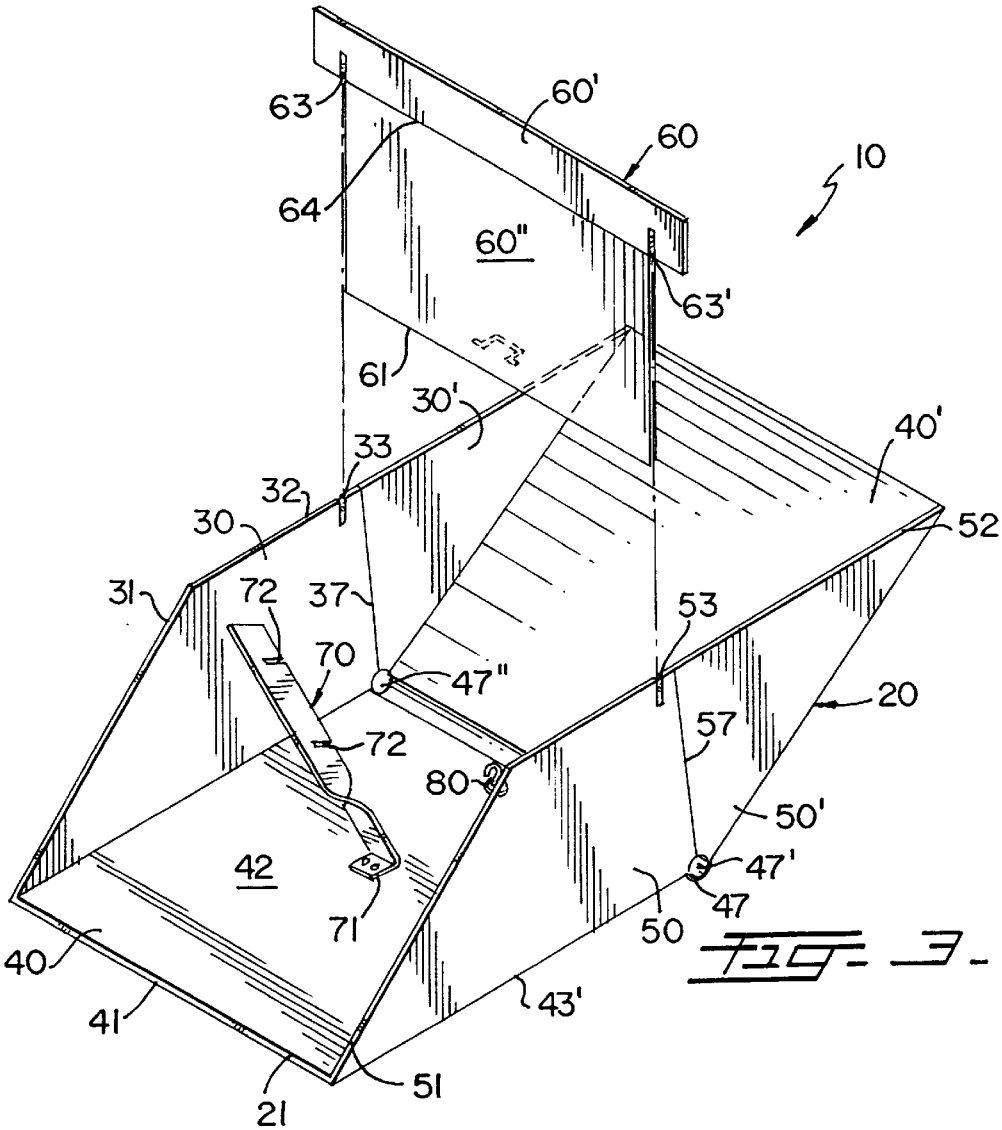
FIG. 3 is a representation of an isometric view of one of the preferred embodiments of the invention shown upside down.

As shown in FIG. 3, slots 33 and 53 extend perpendicularly from edges 32 and 52, respectively. Slots 33 and 53 are positioned, in the preferred embodiment, about one third of the way in from the front end or wind intake end. Wall 60 includes rectangular fixed portion 60' and wider movable portion 60". Rectangular portion 60' includes slots 63 and 63' cooperatively positioned to engage slots 33 and 53, respectively. Portions 60' and 60" are joined by scored integral hinge 64. When portion 60" is positioned between walls 30 and 50, portion 60" is allowed to freely pivot between two extreme positions.

Figure 4:
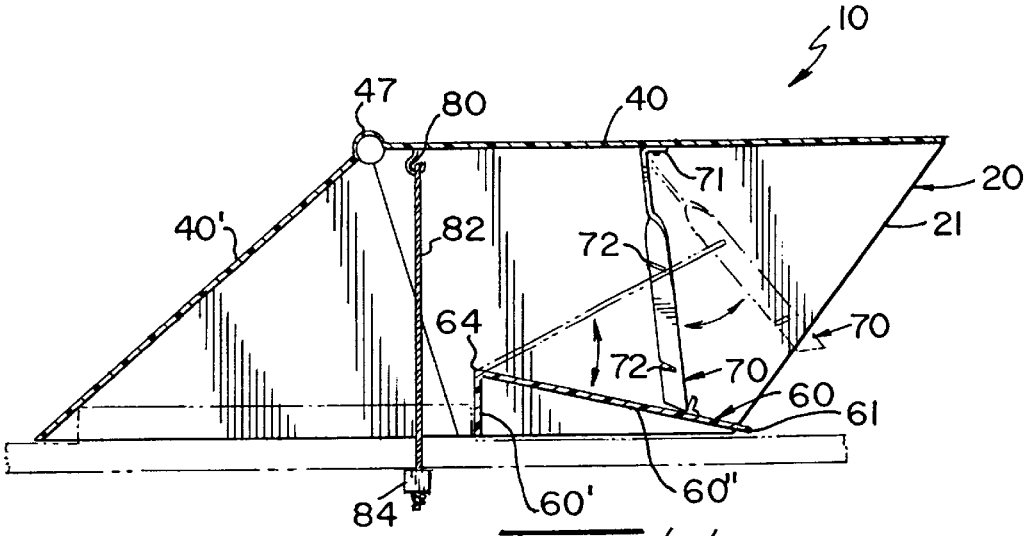
FIG. 4 represents a cross-sectional elevational view taken along line 4—4 in FIG. 1.

As shown in FIG. 4, the solid lines reflect one of the extreme positions corresponding to maximum air intake. The other extreme position, corresponding to low air intake, is represented by the broken lines. Portion 60' is kept in place with notched bar 70 that has end 71 pivotally mounted to the interior of wall 40 at a point relatively close to edge 41. Bar 70 includes notches 72 that lockingly receive edge 61 to keep portion 60" in a predetermined position.

Figure 6:
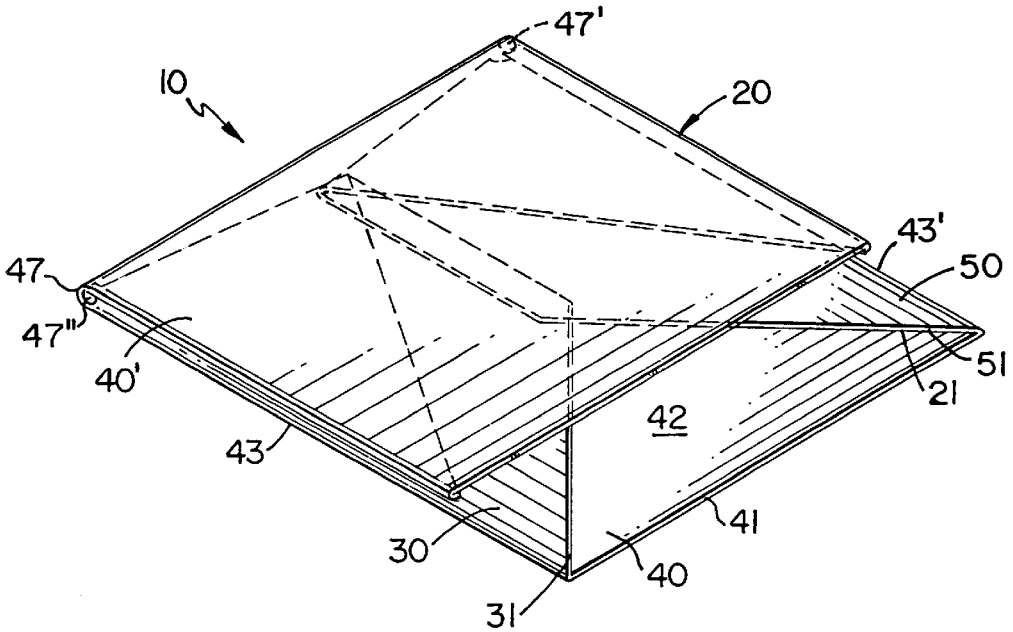
FIG. 6 shows an isometric view of the invention, folded and ready to be stored.
Figure 5:
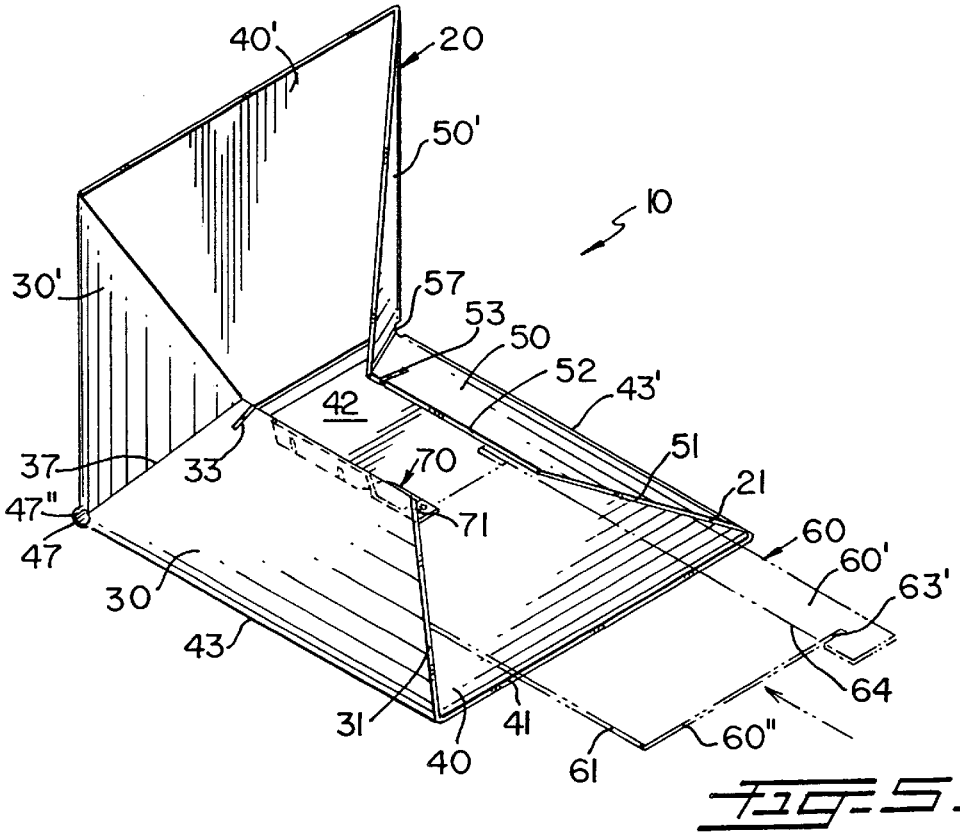
FIG. 5 illustrates an isometric view of the invention being folded.

As depicted in FIG. 5, walls 30 and 50 have the same shape. To fold the present invention for storage, a user places the invention upside down and pulls out wall 60 by disengaging slots 63 and 63' from slots 33 and 53, respectively. Upon disengagement, the user lays wall 60 flat on the inside face 42 of wall 40. The user then pushes wall 30, folding it at scored integral hinge 43, to bring rear portion 30' and wall 30 adjacent to each other. Then, the user pushes at wall 50 folding it at scored integral hinge 43' in an inward direction. To complete the folding procedure, the user pushes rear portion 40' in a downward direction until scored integral hinges 37 and 57 are substantially parallel to integral hinge 47. The resulting folded wind scoop 10 is shown in FIG. 6.

The present invention provides a simple volumetric efficient solution to storage problems for wind scoops that have, to this date, been bulky. Applicant's solution includes a device that is also easy to transport and assemble.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A wind scoop mounted over an opening adapted to direct the wind through said opening, said wind scoop comprising:

A) a rigid yet foldable sheet along predetermined scores define contiguously disposed first, second and third walls with adjacent walls perpendicular to each other, and a rear wall connecting said first, second and third walls;

B) a rectangular fourth wall having four sides and being removably mounted to said first and third walls and having cooperative dimensions to be pivotally housed within said first, second and third walls, and said fourth wall being movable between two extreme positions, one of said positions being a closed position that prevents substantially any air from going through said opening and the other extreme position wherein said fourth wall is kept in a parallel and spaced apart relationship with respect to said second wall;

C) means for adjusting the angle of said fourth wall so that the intake wind diverted towards said opening can be adjusted.

2. The wind scoop set forth in claim 1 further including:

D) means for removably mounting said wind scoop over said opening.

3. The wind scoop set forth in claim 2 wherein said side that is removably mounted to said first and third walls extends a predetermined distance beyond said first and third walls and further includes two ends with first slots at each end for receiving said first and third walls, respectively.

4. The wind scoop set forth in claim 3 further including second slots cooperatively positioned on said first and third wall to removably engage said first slots.

5. The wind scoop set forth in claim 4 wherein said means for adjusting the angle of said fourth wall includes a bar with a plurality of slots for receiving the side of said fourth wall opposite to the side that is mounted to said first and third wall.

6. The wind scoop set forth in claim 5 wherein said means for removably mounting said wind scoop over said opening includes an elastic cord with first and second ends, said first end being removably mounted to said second wall and an elongated member having dimensions that are larger than said opening, said elongated member being attached to said second end, and the length of said elastic cord being selected to keep said elastic cord in stretched state urging said wind scoop against the area surrounding said opening.

7. The wind scoop set forth in claim 6 wherein said rear wall and said second wall include a common integral hinge formed by two straight scores parallel to each other so that when said second and rear walls are folded towards each other, said second and rear wall are kept at a parallel and spaced apart relationship respect to each other thereby defining a space for storage inbetween.

8. The wind scoop set forth in claim 7 wherein said fourth wall includes a fixed portion and a movable portion, and said portions being separate by an integral hinge, said fixed portion defined, at one end, by one of said sides and being removably mounted to said first and third walls.

9. The wind scoop set forth in claim 8 wherein said wind scoop is manufactured from polypropilene, polyethylene, or other materials having similar characteristics.

* * * * *